United States Patent [19]

Pellerin

[11] Patent Number: 4,777,683

[45] Date of Patent: Oct. 18, 1988

[54] TREATMENT OF CLOTH OR OTHER LIQUID ABSORBENT GOODS

[75] Inventor: Norvin L. Pellerin, New Orleans, La.

[73] Assignee: Pellerin Milnor Corporation, Kenner, La.

[21] Appl. No.: 129,171

[22] Filed: Dec. 7, 1987

[51] Int. Cl.[4] ..... D06F 33/02; D06F 39/08

[52] U.S. Cl. ..... 8/158; 68/12 R; 68/207

[58] Field of Search ..... 8/158; 68/12 R, 207

[56] References Cited

U.S. PATENT DOCUMENTS

| | | | |
|---|---|---|---|
| 2,554,672 | 5/1951 | Johnston | 68/13 R |
| 2,911,811 | 11/1959 | Clark | 68/12 R |
| 2,934,928 | 5/1960 | Shelton | 68/207 |
| 3,086,836 | 4/1963 | Ohmann | 8/158 |
| 3,470,718 | 10/1969 | Scourtas | 68/12 R |
| 4,184,347 | 1/1980 | Tobita et al. | 68/207 X |
| 4,303,406 | 12/1981 | Ross | 8/158 |
| 4,428,088 | 1/1984 | Getz et al. | 8/158 |
| 4,480,449 | 11/1984 | Getz et al. | 68/12 R |

FOREIGN PATENT DOCUMENTS

| | | | |
|---|---|---|---|
| 3329346 | 2/1985 | Fed. Rep. of Germany | 68/12 R |
| 113970 | 9/1979 | Japan | 68/207 |
| 2008796 | 1/1987 | Japan | 68/207 |
| 2041692 | 2/1987 | Japan | 68/207 |

*Primary Examiner*—Philip R. Coe

*Attorney, Agent, or Firm*—Vaden, Eickenroht, Thompson & Boulware

[57] ABSTRACT

There are disclosed a machine for and method of treating cloth goods received within a rotatable drum by means of measured quantities of treatment fluid added to and drained from the machine at the beginning and end of successive cycles of drum rotation.

6 Claims, 1 Drawing Sheet

TREATMENT OF CLOTH OR OTHER LIQUID ABSORBENT GOODS

Figure 1:
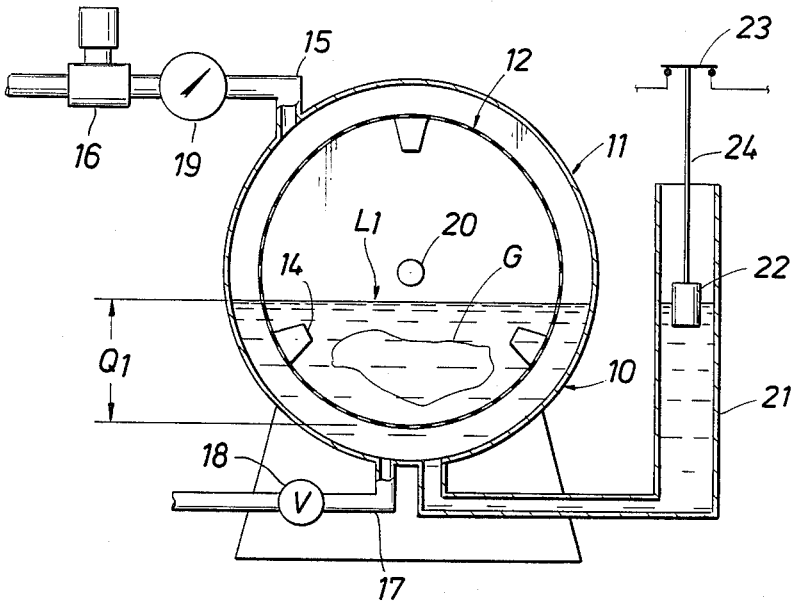

This invention relates generally to dyeing, washing or otherwise treating cloth or other liquid absorbent goods in a liquid bath. More particularly, it relates to improvements in machines for and methods of treating such goods wherein the goods are received in a rotatable drum for treatment within measured quantities of treatment liquid which are added to and drained from the machine prior to and following successive cycles of drum rotation.

Typical machines of the type contemplated by the present invention are known as dyeing-extractors and washer/extractors. In each case, the drum may be rotated at relatively slow speeds during initial cycles of treatment and at high speeds during a final cycle in order to extract excess liquid from the goods. Conventionally, the drum is perforated and rotates within an outer container to and from which the liquid is added and drained.

The treatment liquid includes water to which chemicals may be added during successive cycles, such as a scouring agent and dye in the case of a dyeing-extractor, and bleach, detergent, and other agents in the case of a washer/extractor. In order to control the strength of the chemicals, the machine should be filled with a total quantity of liquid during each cycle which bears a predetermined ratio ("liquor ratio") to the weight of the goods.

Since the goods are in a dry state, or at least in a state in which they contain a known quantity of liquid, at the beginning of the first cycle, it is merely necessary to add a measured quantity of liquid equal to that necessary to attain the desired liquor ratio. However, the liquid is drained from the machine following the first cycle, some of it remains in the goods, the amount actually remaining depending on the length of the drain and whether the cycle includes a spin or high speed extraction cycle prior to drain. For example, as much as 35% of the liquid may be absorbed in the goods, such that only 65% drains following a normal cycle. In the case of a spin cycle, however, as much as 90% of the liquid may be drained. Thus, it is not possible with conventional machines to add a measured quantity of liquid equal to the total quantity required to attain the desired liquor ratio for subsequent cycles when the required quantities of liquid may and usually will differ.

Also, the degree to which liquor is absorbed in successive batches of goods depends on the type of goods. That is goods which absorb less liquor may require a higher liquid level in order to achieve a given liquor ratio. Hence, the total quantities of liquid required during successive cycles of treatment of a batch of one type of goods may and usually will differ from that required to treat a batch of another type of goods.

The object of this invention is to provide a machine for as well as a method of treating cloth or other liquid absorbent goods which enables the attainment of desired liquor ratios during subsequent cycles of treatment, as well as the treatment of successive batches of goods having different liquid absorbability, without the necessity of directly measuring the amount of liquid retained in the goods.

This and other objects are accomplished, in accordance with the illustrated embodiment of the present invention, by a machine for and a method of treating the goods wherein means are provided for sensing the addition of liquid to the machine at the beginning of the first cycle to attain a predetermined level which is adequate to wet the goods but not higher than that to which liquid must be raised in order to add the total quantity of liquid required for treatment during each cycle, and for determining the quantity of liquid added to attain that level. More particularly, a means is also provided for subtracting the determined quantity from the total quantity of liquid required for treatment during the first and each subsequent cycle in order to arrive at the additional quantity of liquid to be added, following raising of the liquid to the predetermined level, in order to attain the total quantity required for that cycle. Thus, it is possible to attain the desired liquor ratio during each cycle, including during treatment of subsequent batches, regardless of the amount of liquid which remains in the goods at the end of each cycle and/or the water absorbability of the goods treated in different batches.

In its illustrated embodiment, the machine includes a float for rising with the liquid level, and means responsive to a rise of the float, upon raising of the liquid to the predetermined level, to record the quantity of liquid measured by the liquid adding means to attain the predetermined level. The recorded quantity may be stored in the memory of a suitable computer in which the total quantities required for each cycle have been entered, whereby, following attainment of the predetermined level, the liquid adding means may be commanded to add an additional quantity, following raising of the liquid to the predetermined level at the beginning of that cycle, equal to the difference between the total quantity required for that cycle and the determined quantity.

Figure 2:
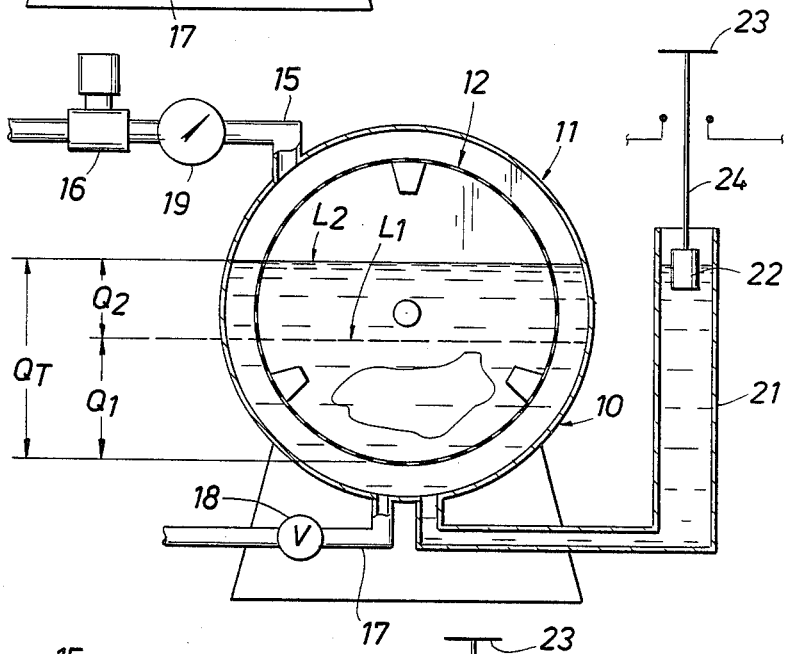
Figure 3:
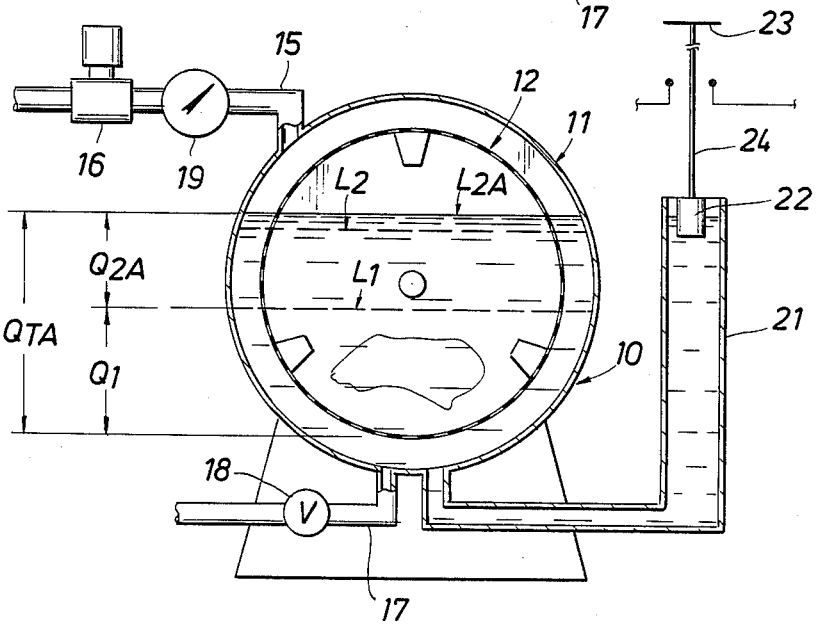

In the drawings, wherein like reference characters are used through out to designate like parts:

FIG. 1 is a diagrammatic, cross sectional view of a machine constructed in accordance with the present invention, and showing liquid added thereto, at the beginning of a first cycle, to a level L1 above the goods contained in the drum thereof, and a float disposed in a liquid leg to one side of the container in which the drum is rotatable which has risen with the liquid to activate a switch which transmits a signal to a flowmeter associated with a valve controlling the liquid adding means for determining the quantity of liquid added to obtain that level;

FIG. 2 is a view similar to FIG. 1, but upon the addition of an additional quantity of liquid equal to the difference between the total quantity required for the first cycle and the determined quantity, and FIG. 3 is a view similar to FIGS. 1 and 2, but upon drainage of liquid to the machine following the first cycle of treatment and the addition of a quantity of liquid thereto at the beginning of a subsequent cycle equal to the total required for that cycle.

With reference now to the details of the above described drawings, the machine 10 is shown to comprise a stationary outer container 11 mounted on a pedestal 12, and a drum 13 mounted within the drum for rotation coaxially thereof. The drum is perforated and has an end (not shown) which may be opened to permit cloth goods G to be added to or removed therefrom. Ribs 14 extend along the inside of the drum to assist in tumbling the goods as the drum is rotated during each treatment cycle.

Liquid is adapted to be added to the container through an inlet 15 connected with its upper end and a valve 16 in the inlet for opening and closing it. Liquid is adapted to be drained from the container through an outlet 17 in its lower end and a valve 18 for opening and closing the outlet. A flowmeter 19 is disposed in the inlet 15 downstream of the valve 16 for measuring the quantity of liquid added to the container upon opening of the valve 16.

The drum has a central shaft 20 supported by the container for rotation by a motor(not shown) so as to cause the liquid to circulate through the goods during each treatment cycle. The motor is of a variable speed type to permit the drum to be rotated at a relatively slow speed during initial cycles and at high speed during an extraction cycle. The valve 18 may be opened to drain liquid from the container at the end of each cycle, and then closed preparatory to a subsequent cycle.

To the extent above described, the machine is of more or less conventional construction adapted either for use as a dyeing/extractor or washer/extractor. In either case, the liquid comprises water containing chemicals for treating the goods in a desired fashion, and, as previously described, it is desirable that the quantity of liquid added to the machine at the beginning of each cycle bear a predetermined relation to the quantity of goods to be treated. This relationship, known as the liquor ratio, is normally expressed in pounds of liquid for each pound of goods.

As also previously mentioned, the goods may vary, from one batch to another, not only in weight but also in liquid absorbability. Thus, if a desired liquor ratio is to be maintained during each cycle, the liquid levels of the total quantity of liquid required will vary from one batch to the next.

As shown in the drawings, the machine also includes an upright water leg 21 to one side of the container 11 and connected to its lower end, and a float 22 in the water leg for rising with the liquid level in the leg and thus the container. The float is connected to a switch 23 by means of a rod 24 and is so arranged as to be activated—opened as shown—when liquid has been added to a level L1 which guarantees that the goods are fully wetted. As shown in FIG. 1, this level $L_1$ is above the goods G received in the drum, although it will be understood that if the drum is rotated as liquid is added, and the goods are thoroughly doused at the beginning of the first cycle, the level $L_1$ may be below the top of the goods.

The opening of switch 23 transmits a signal to suitable means associated with the flowmeter 19 to determine the measured quantity Q1 of liquid which was added to attain that level. The quantity so determined is then recorded and stored in the memory of a suitable computer in which the total quantities of liquid required for the first and each subsequent cycle have been entered. As previously mentioned, this invention contemplates that the required quantities may differ, although obviously they may be equal.

The computer has suitable means for subtracting the determined quantity from the required quantity and thus determining the quantity of liquid to be added, following attainment of the liquid level L1, and then commanding the flowmeter to add that additional quantity and the inlet valve to then close in order to attain the required quantity for treatment during each cycle. Thus, upon attainment of the level L1 at the beginning of the first cycle, the computer subtracts quantity Q1 from the total quantity QT required for the first cycle in order to arrive at quantity Q2 to be added following attainment of that predetermined level.

Although the liquid may be drained upon completion of the first cycle, some will remain in the goods, the amount depending on the factors previously discussed. However, by virtue of this invention, that amount need not be measured, either upon drainage at the end of the first cycle or any subsequent cycle. Instead, as treatment liquid is added to achieve the level L1 at the beginning of each subsequent cycle, quantity Q1 is automatically subtracted from the total quantity required for that cycle in order to determine the additional quantity to be added to attain the total required for the second cycle, which, as shown at $QT_A$ in FIG. 3, may differ from that required for the first cycle. Thus, the quantity $Q2_A$ to be added will also differ, depending solely upon the total quantity $QT_A$ to be added and regardless of the amount of liquid retained in the goods at the end of the prior cycle.

It is also contemplated that liquid may not be drained at the end of each cycle. For example, one or more subsequent cycles may use the same liquor, but require that additional liquor be added to achieve a higher liquor ratio. In this case, it would merely be necessary to add additional liquor at the beginning of the next cycle.

In the treatment of another batch, the goods may differ in quantity, or, even if of the same quantity, may differ in liquid absorbability. However, apart from the possible adjustment of the level sensing means, the machine is ready for use.

From the foregoing it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed:

1. In a machine for treating cloth goods which includes a rotatable drum in which cloth or other liquid absorbent goods may be received and means by which measured quantities of treatment liquid may be added to and drained from the machine prior to and following each cycle of drum rotation, the improvement comprising means for sensing the addition of liquid to the machine at the beginning of the first cycle to a predetermined level which is adequate to fully wet the goods but not higher than that to which liquid must be raised to add the total quantity of liquid required for treatment during each cycle, means for determining the quantity of liquid added to attain that predetermined level, and means for subtracting the determined quantity from the total quantity of liquid required for treatment during the first and each subsequent cycle, which follows drainage at the end of the prior cycle, in order to arrive at the additional quantity of liquid to be added, following raising of the liquid to the predetermined level, in order to attain the total quantity required for that subsequent cycle.

2. In a machine of the character defined in claim 1, wherein the drum is rotatable within an outer container of the machine and to which liquid is added and from which liquid is drained, and the drum is perforated to enable the liquid to impregnate the cloth goods.

3. A machine for treating cloth or other liquid absorbent goods, comprising a rotatable drum in which the goods may be received, means for adding measured quantities of treatment liquid to and draining liquid from the machine prior to and following successive cycles of drum rotation, means for sensing the addition of liquid to the machine at the beginning of the first cycle to a predetermined level which is adequate to fully wet the goods but not higher than that to which liquid must be raised to add the total quantity required for treatment during the first cycle, means for determining the quantity of liquid added to attain that level, and means for subtracting the determined quantity from the total quantity of liquid required for treatment during the first cycle, as well as from the total quantity required for treatment during each successive cycle, which follows drainage at the end of the prior cycle, in order to arrive at the additional quantity of liquid to be added, following raising of the liquid to the predetermined level, in order to attain the total quantity required for that subsequent cycle.

4. A machine of the character defined in claim 3, including a float for rising with the liquid level, and means responsive to the rise of the float to record the quantity of liquid measured by the liquid adding means when the liquid reaches said predetermined level at the beginning of the first cycle.

5. In a method of treating cloth or other liquid absorbent goods within a machine having a rotatable drum in which the goods may be received and means for adding measured quantities of treatment liquid to and draining liquid from the machine prior to and following each cycle of drum rotation, the steps of sensing the addition of liquid to the machine at the beginning of the first cycle to a predetermined level which is adequate to fully wet the goods in the drum but not higher than that to which liquid must be raised to add the total quantity of liquid required for treatment during each cycle, determining the quantity of liquid added to attain that level, and subtracting the determined quantity from the total quantity of liquid required for treatment during the first and each subsequent cycle which follows drainage at the end of the prior cycle, in order to arrive at the additional quantity of liquid to be added, following raising of the liquid to the predetermined level, in order to attain the total quantity required for that subsequent cycle.

6. A method of treating cloth or other liquid absorbent goods within a machine having a rotatable drum in which the goods may be received and means for adding measured quantities of treatment liquid to and draining liquid from the machine at the beginning and end of successive cycles of drum rotation, the steps of disposing a batch of the goods within the drum, sensing the addition of liquid to the machine at the beginning of the first cycle of treatment to a predetermined level which is adequate to thoroughly wet the goods but not higher than that to which liquid must be raised to add the total quantity of water required for treating the goods during each cycle, determining the quantity of liquid added to attain that level, adding a further quantity of liquid to the machine which is equal to the difference between the total quantity of liquid required for treatment during the first cycle and the determined quantity, draining liquid from the machine at the completion of at least one cycle, adding liquid to the machine at the beginning of the cycle subsequent to the one cycle until it reaches the predetermined level, sensing the addition of liquid to that level, and adding a further quantity of liquid to the machine which is equal to the difference between the total quantity of liquid required for treatment during that one cycle and the determined quantity.

* * * * *